US005803624A

United States Patent [19]

Miazga et al.

[11] Patent Number: 5,803,624

[45] Date of Patent: Sep. 8, 1998

[54] METHODS AND APPARATUS FOR COMPENSATNG STEP DISTANCE IN A STEPPING MOTOR DRIVEN LABEL PRINTER

[75] Inventors: Jay M. Miazga, Marysville; Thomas A. Sweet, Everett; Glenn D. Wildfong, Woodinville, all of Wash.

[73] Assignee: Intermec Corporation, Everett, Wash.

[21] Appl. No.: 522,738

[22] Filed: Aug. 31, 1995

[51] Int. Cl.[6] ..... B41J 21/16

[52] U.S. Cl. ..... 400/103; 400/902

[58] Field of Search ..... 400/61, 68, 74, 400/103, 104, 902

[56] References Cited

U.S. PATENT DOCUMENTS

| | | | |
|---|---|---|---|
| 4,661,001 | 4/1987 | Takai et al. | 400/103 |
| 4,699,531 | 10/1987 | Ulinski | 400/74 |
| 5,061,947 | 10/1991 | Morrison | 400/618 |
| 5,259,678 | 11/1993 | Uchida | 400/103 |
| 5,480,244 | 1/1996 | Senda | 400/74 |
| 5,498,087 | 3/1996 | Wey | 400/68 |
| 5,564,841 | 10/1996 | Austin et al. | 400/74 |
| 5,628,574 | 5/1997 | Crowley | 400/74 |

FOREIGN PATENT DOCUMENTS

| | | | |
|---|---|---|---|
| 61-244572 | 10/1986 | Japan | 400/68 |
| 63-145062 | 6/1988 | Japan | 400/68 |
| 216868 | 8/1989 | Japan | 400/68 |
| 116393 | 5/1993 | Japan | 400/68 |

*Primary Examiner*—Edgar S. Burr
*Assistant Examiner*—Steven S. Kelly
*Attorney, Agent, or Firm*—Graham & Jones LLP

[57] ABSTRACT

A label printer having a stepping motor and the ability to dynamically accurately control longitudinal label registration as a function of steps of the stepping motor. The effective length of the steps moving the labels between a known point prior to the printhead and the printhead are monitored and the number of steps actually used to move the labels between the known point and the printhead are adjusted as a function of changes in the effective step length. In one embodiment, a sensor counts the steps between consecutive labels or averages a number of labels to determine the effective step length. In another embodiment, a sensor detects the start of label and start of printing on the label and the step distance between the two is used to determine the effective step length.

4 Claims, 6 Drawing Sheets

METHODS AND APPARATUS FOR COMPENSATNG STEP DISTANCE IN A STEPPING MOTOR DRIVEN LABEL PRINTER

BACKGROUND OF THE INVENTION

1. Technical Field

This invention relates to label printers printing on multiple labels sequentially carried by a moving web and, more particularly, to a label printer having a stepping motor for moving a strip media comprising a plurality of equally-spaced labels carried by a backing strip between a sensor and a printhead and having the ability to accurately control longitudinal label registration as a function of steps of the stepping motor comprising, a printhead positioned to print on labels moving thereunder; a sensor positioned to sense a longitudinal registration point of labels passing thereunder relative to the printhead; a drive roller positioned to move the media under the printhead for printing thereon; a stepping motor driving the drive roller; and, control logic controlling the stepping motor for, counting steps of the stepping motor required to move one label from a known longitudinal position at the sensor and a next following label to the known longitudinal position, and adjusting the number of steps employed by the control logic to move one label from the known longitudinal position to a registered position under the printhead as a function of any difference between a number of steps counted and a prior-determined baseline number of steps.

2. Background Art

In a label printer such as that generally indicated as 10 in FIG. 1, a plurality of labels 12 are releasably attached to a backing strip 14 forming a strip of media 15 that extends from a supply roll 16 over a plurality of guide rollers 18 to a printhead 20. At the printhead 20, ink from a ribbon 22 extending between a supply roll 24 and a take-up roll 26 is transferred to the labels 12. After printing, the labels 12 are separated from the backing strip 14 by a separator 27 and the backing strip 14 is wound onto a take-up roll 28 for later disposal. The labels 12 and backing strip 14 are moved in combination from the supply roll 16 to the printhead 20 by a driven platen roller 30 which also supports the labels 12 and backing strip 14 under the printhead 20 during the printing process. To keep the cost of the printer 10 low, the take-up roll 26, the take-up roll 28, and the platen roller 30 are all driven directly or indirectly by a single stepping motor 32 as indicated by the dashed lines. The movement of the stepping motor 32 is under the control of logic 34.

Several issues must be addressed with respect to driving the stepping motor 32. As conditions change in the path, the load on the stepping motor 32 changes. While the stepping motor 32 continues to rotate in steps of equal radial distance, changes in load result in changes in effective step length moved by the media 15 in the vicinity of the printhead 20. As a result, a primary issue that is affected is finding the top-of-form or, in this case, a pre-established reference point on each next label 12. A convenient reference point is the front edge 36 of each label 12. Of course, a reference mark on the label or even the backing 14 could be employed. The important thing is that the printing of one label 12 start at a pre-established and known longitudinal reference point and that when the label 12 has been printed, the next label 12 in line can be accurately and repeatedly positioned with its reference point under the printhead 20. This is particularly true with the smaller labels that are being introduced for use on printed circuit boards (PCBs) and the like. By using two-dimensional labels, a lot more information can be put into a small space as compared with the familiar linear barcodes employed on retail goods and such. Since the labels are small, it is important that linear registration be accurate and repeatable since a small variation can cause part of the information to be lost over an edge.

Speed is also a factor in label printing. Thus, what is needed is a way of assuring linear positioning accuracy with the printer running at high speed. And, since the loads within the printer change dynamically as a function of factors such as the size of the supply roll 16, placement accuracy needs to be automatically and dynamically adjustable.

In a typical prior art label printer, a linear position sensor 33 senses the leading edge 36 of the next label 12 before the printhead 20. It is pre-established that the distance from the sensor 33 to the properly registered printing position under the printhead 20 is a fixed number, "N", steps of the motor 32. This assumes, of course, that the distance between leading edges 36 of the labels 12 on the backing strip 14 is constant—which is a valid assumption since the labels are die-cut with automated machinery to exact specifications.

The prior art approach was and is a completely valid approach if printing speeds are low, dynamic loading is relatively constant, and label sizes are large. Unfortunately, as described above, printer speeds are increasing and label sizes are decreasing dramatically. In addition, there is a need to maintain tension on the backing strip 14 and the ribbon 22 to prevent wrinkling of either, or both, during the printing process. If one is driving the take-up rollers 26 and 28 with a single motor 32 that is also driving the platen roller 30, it can be appreciated that there can be broad dynamic swings in loading on the motor 32 and media 15 that will affect the effective step distance traveled by the media 15. It is unknown whether this is a result of slippage, elastomeric shift, and/or media stretch. All that is known is that the number of steps required by the motor 32 to move a label 12 from the sensor 33 to the first printing position under the printhead 20 does not remain constant. In fact, it changes in an amount which prevents repeated accurate placement of the printing on small labels in an amount which is beyond acceptable variance limits.

Wherefore, it is an object of this invention to provide a way in which a stepping motor driving a label printer having multiple adjacent labels longitudinally positioned on a web can accurately and repeatedly position the labels with a pre-established reference point under the printhead.

It is another object of this invention to provide a way in which a single stepping motor driving a label printer having multiple adjacent labels longitudinally positioned on a web can maintain proper tension on the backing and the ribbon to prevent wrinkling or other problems in the printing process that can affect the resultant print quality on the labels.

It is still another object of this invention to provide a way in which a single stepping motor driving a label printer having multiple adjacent labels longitudinally positioned on a web can automatically adjust for changes in system tension or drag.

Other objects and benefits of this invention will become apparent from the description which follows hereinafter when read in conjunction with the drawing figures which accompany it.

SUMMARY

The foregoing objects have been achieved by the label printer of the present invention having a stepping motor for moving a strip media comprising a plurality of equally-spaced labels carried by a backing strip between a sensor and a printhead and having the ability to accurately control longitudinal label registration as a function of steps of the stepping motor comprising, a printhead positioned to print on labels moving thereunder; a sensor positioned to sense a longitudinal registration point of labels passing thereunder relative to the printhead; a drive roller positioned to move the media under the printhead for printing thereon; a stepping motor driving the drive roller; and, control logic controlling the stepping motor for, counting steps of the stepping motor required to move one label from a known longitudinal position at the sensor and a next following label to the known longitudinal position, and adjusting the number of steps employed by the control logic to move one label from the known longitudinal position to a registered position under the printhead as a function of any difference between a number of steps counted and a prior-determined baseline number of steps by, adding steps to the number of steps employed by the control logic to move one label from the known longitudinal position to a registered position under the printhead if the number of steps counted is greater than the prior-determined baseline number of steps, and subtracting steps from the number of steps employed by the control logic to move one label from the known longitudinal position to a registered position under the printhead if the number of steps counted is less than the prior-determined baseline number of steps.

The preferred embodiment also includes means for adjusting the number of steps employed by the control logic to move one label from the known longitudinal position to a registered position under the printhead as function of an average number of steps required to move a plurality of labels from to the known longitudinal position at the sensor.

There may also be a ribbon supply roll; a ribbon take-up roll; a strip of inked ribbon disposed between the ribbon supply roll and the ribbon take-up roll and passing under the printhead; and, means for maintaining the strip of inked ribbon under tension to prevent wrinkling thereof. The latter means may comprise a motor driving the ribbon take-up roll; and, a drag-inducing mechanism attached to the ribbon supply roll. Or, it may comprise a motor applying an over-force to the ribbon take-up roll. The motor applying an over-force to the ribbon supply roll may be the stepping motor.

Additionally or alternatively, there may also be a media supply roll; a backing strip take-up roll; the strip media being disposed between the media supply roll and the backing strip take-up roll and passing longitudinally under the printhead; and, means for maintaining the strip media under tension to prevent wrinkling, vertical mis-positioning and lateral wandering thereof. The latter means may comprise a motor driving the backing strip take-up roll; and, a drag-inducing mechanism attached to the media supply roll. Or, it may comprise a motor applying an over-force to the backing strip take-up roll. The motor applying an over-force to the backing strip take-up roll may be the stepping motor.

The foregoing objects have also been achieved in a barcode label printer having a printhead positioned to print barcodes on labels moving thereunder, a drive roller positioned to move a plurality of labels carried by a backing strip under the printhead for printing thereon, and a stepping motor driving the drive roller so as to accurately control longitudinal label registration as a function of steps of the stepping motor, by the apparatus of the present invention for dynamically adjusting the steps of the stepping motor to compensate for changes in effective step length effecting longitudinal registration of barcodes printed on the labels comprising, a sensor outputting a first signal upon sensing a leading edge of a just-printed label and outputting a second signal upon sensing a first bar of a barcode of the just-printed label; and, control logic connected to the sensor to receive the first signal and the second signal for, outputting a number of steps to the stepping motor to move each label from a known longitudinal position to a registered position under the printhead, continuously sensing a start of label point and a start of barcode point on each label just printed and counting steps of the stepping motor required to move each just printed label from the start of label point to the start of barcode point, comparing the number of steps of the stepping motor required to move each just printed label from the start of label point to the start of barcode point to a baseline value, and adjusting the number of steps to the stepping motor employed to move one label from the known longitudinal position to the registered position under the printhead as a function of any change between a latest counted value of the number of steps of the stepping motor required to move each just printed label from the start of label point to the start of barcode point to a baseline value.

DESCRIPTION OF THE PREFERRED EMBODIMENT

Figure 2:
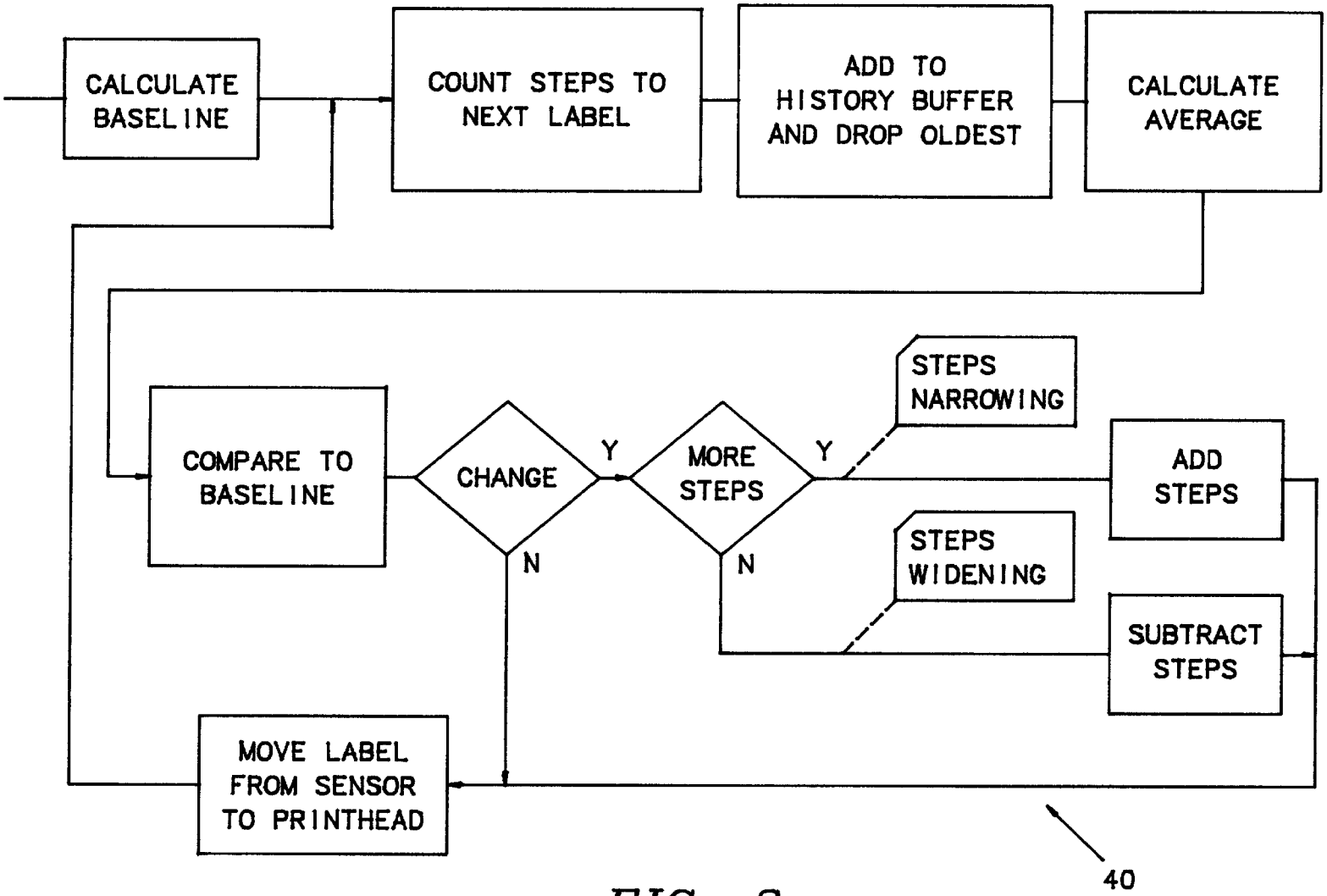
FIG. 2 is a flowchart of exemplary logic to be used in the label printer of FIG. 1.

The primary and secondary objects of the present invention have been achieved in a first and preferred embodiment of the present invention by connecting a history buffer 38 to the control logic 34 and including logic 40 such as that shown in FIG. 2 within the control logic 34. The methodology of the present invention in this embodiment comprises establishing a baseline of average steps of the stepping motor 32 required to move a plurality of labels 14 from reference point to reference point. As mentioned earlier, a convenient reference point is the leading edge 36 of the labels 12. The average of a plurality of labels 12 is employed in establishing the baseline to smooth out the number being used as the test point as is a common mathematical technique in such statistical evaluations. In a tested embodiment, the history buffer 38 contains the number of steps of the stepping motor 32 which it took to move from the leading edge 36 of one label 12 to the leading edge 36 of the next label 12 for the most recent thirty-two labels. As those of ordinary skill in the art will readily recognize and appreciate, thirty-two is an arbitrary number and any number can be used as desired by the implementor, including the number"1", i.e. changing as a result of any changes from label to label without regard to an average over time. Other statistical evaluations could also be employed within the scope and spirit of the present invention keeping in mind that the most basic approach of the present invention is to determine if the effective step distance moving the labels 12 from the sensor 33 to the printhead 20 is changing for any reason and to dynamically change the number of steps employed by the stepping motor to compensate for those changes.

Figure 1:
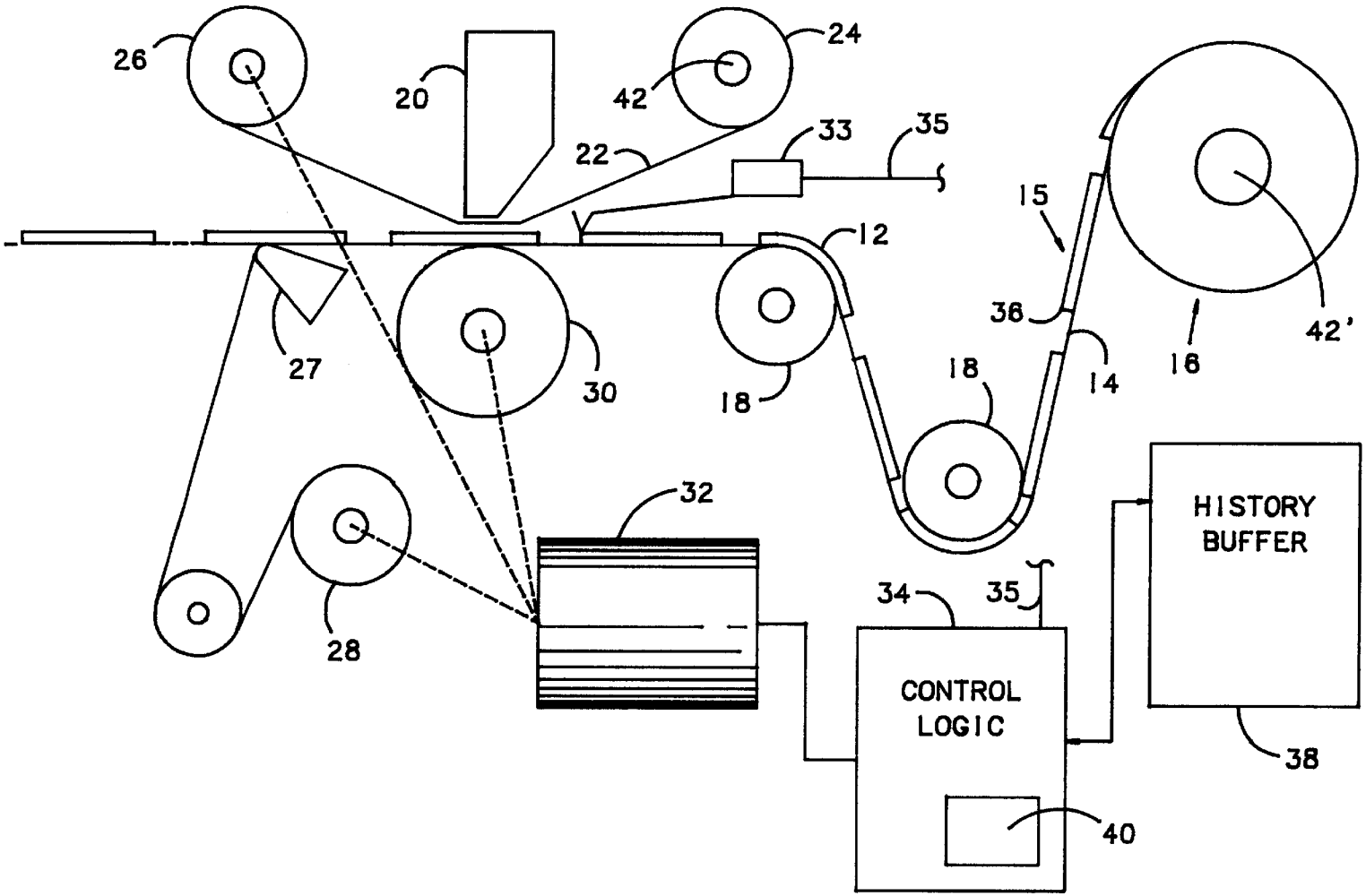
FIG. 1 is a simplified side view drawing and partial functional block diagram of a label printer according to the present invention in a preferred embodiment.

In the tested embodiment of FIG. 1, the baseline average value is calculated by moving thirty-two labels 12 through the printer 10 under nominal conditions and provides a starting point when printing is begun for the media 15 being printed upon. The nominal distance in steps from the sensor 33 to the printhead 20 is known in advance and the label-to-label distance in steps is measured each time printing begins. Thus, if a new media 15 is loaded into the printer, the present invention automatically re-parameterizes itself. Once printing has begun, the logic 40 added to the basic control logic 34 by the present invention constantly reassesses and dynamically readjusts the system parameters as depicted in FIG. 2.

As depicted in FIG. 2, the logic 40 is a loop function which, after establishing the baseline value at the start of printing, starts its continuing function by counting the number of steps of the stepping motor 32 which it took to move from the leading edge 36 of a label 12 to the leading edge 36 of the next label 12 for the most recent label 12. That number is added to the history buffer 38 and the oldest entry of the thirty-two entries of the history buffer 38 is discarded. The new average for the thirty-two entries is then calculated and compared to the baseline number calculated at the start of this printing session. If the stepping motor average has increased in the number of steps required, the logic 40 knows that the steps are narrowing as a results of increased drag at some point. In that event, the logic 40 adds steps to the number of steps employed to move the next-in-line label 12 from the sensor 33 to the printhead 20. If the stepping motor average has decreased in the number of steps required, the logic 40 knows that the steps are widening as a results of decreased drag. In that event, the logic 40 subtracts steps from that number. When the logic 40 has completed, it returns to its beginning.

While the primary thrust of the present invention is the assuring of consistent and repeated positioning of the labels 12 under the printhead 20 for accurate printing, as mentioned above the present invention allows the single stepping motor 32 to be used for other purposes. For example, if there is not a constant tension on the ribbon 22 it may wrinkle and cause inconsistencies in the printing on the labels 12. Since the take-up roll 26 is driven by the stepping motor 32, the ribbon 22 can be placed under tension to prevent wrinkling by attaching a drag-inducing mechanism 42 (such as a friction clutch) to the ribbon supply roll 24 or by adding an over-pull force to the take-up roll 26. This, of course, will add drag to the drive train of the stepping motor 32. But, because of the present invention, this is not a problem since the logic 40 will automatically adjust the number of steps of the stepping motor 32 as and if necessary to compensate for the added drag.

The same would be true if a drag-inducing mechanism 42' were added to the supply roll 16 or an over-pull force applied to the take-up roll 28 to place the backing 14 under tension. The latter approach is a preferred way of preventing wrinkling of the backing strip 14 which can also result in lengthening of the effective step length in the area of the printhead 20 since there is a supplemental and additive pull on the media 15 past the printhead in addition to the normal pulling force imparted by the platen roller 30. With the present invention, such additions to the operability of the printer have virtually no effect on the dynamic linear registration of the labels 12 since any change in the effective step length is automatically adjusted for as soon as it appears. And, this is true whether the same stepping motor 32 is used to drive both the platen roller 30 and the take-up roller 28 or separate motors are utilized.

Figure 3:
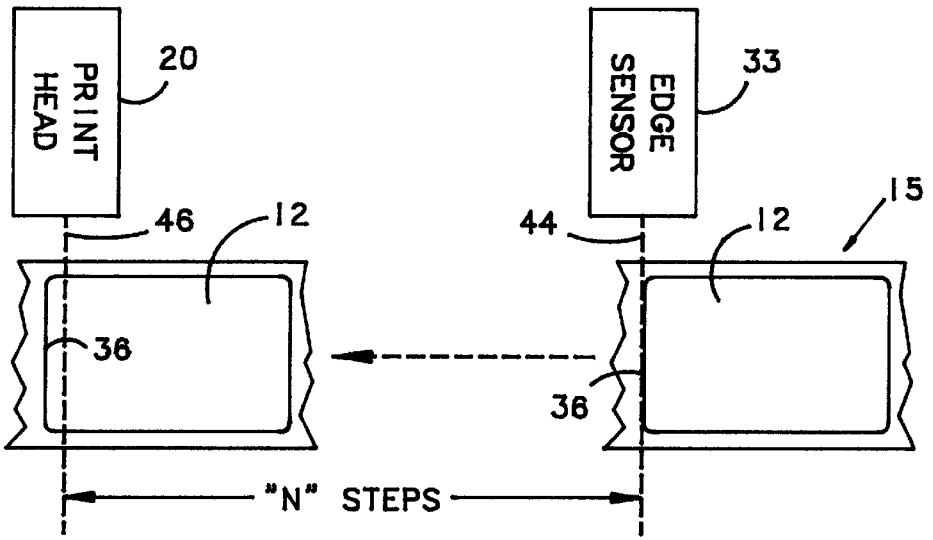
FIG. 3 is a drawing depicting how the edge of the label at its sensing position is offset from the start of printing by a fixed number of steps.

While the above-described preferred embodiment of the present invention is preferred because of its simplicity and ease of implementation with a single edge sensor, i.e. sensor 33, there are other possible implementations of the present invention based on the same underlying approach of dynamically adjusting the number of steps employed to move the labels 12 from a sensing point prior to the printhead 20 to the printhead 20 as depicted in FIG. 3. Alternate and supplemental approaches will now be addressed in detail.

Figure 4:
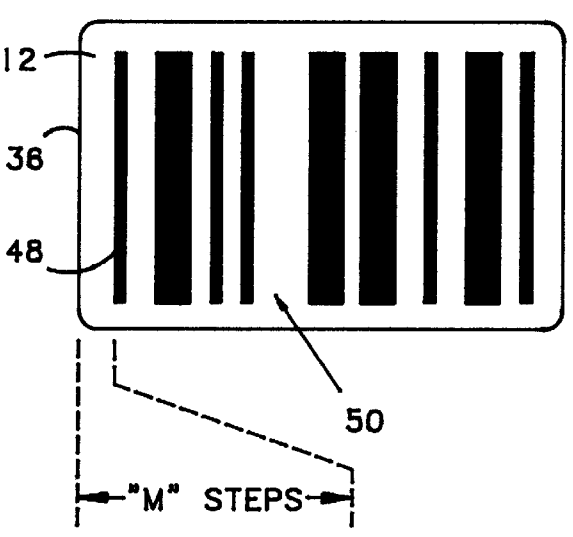
FIG. 4 is an enlarged drawing depicting how the edge of the label is also offset from the start of printing by a fixed number of steps following printing.

As depicted in FIG. 3 and as discussed earlier, there are nominally"N" steps between the position 44 at which the edge sensor 33 detects the leading edge 36 of a label 12 and the position 46 where the printhead 20 actually prints the first line of bars 48 on the label. As depicted in FIG. 4, a barcode 50 printed on a label 12 has"M" nominal steps of distance between the leading edge and the first bar 48. Since changes in effective step length will change the distance between the leading edge 36 and the first bar 48 as measured in steps, that distance can also be employed to adjust the steps employed in the stepping motor 32. As those of ordinary skill in the art will readily recognize and appreciate, the previously described approach of FIG. 1 was an open loop system. If feedback of the effect of printing is used to adjust the system, it will be a closed loop system. It will also be recognized and appreciated that using the after-printing changes in the registration on the label 12 can be accomplished as a stand-alone approach or can be used to supplement the approach of FIG. 1. For simplicity and the avoidance of redundancy, only the stand-alone approach will be discussed herein.

Figure 5:
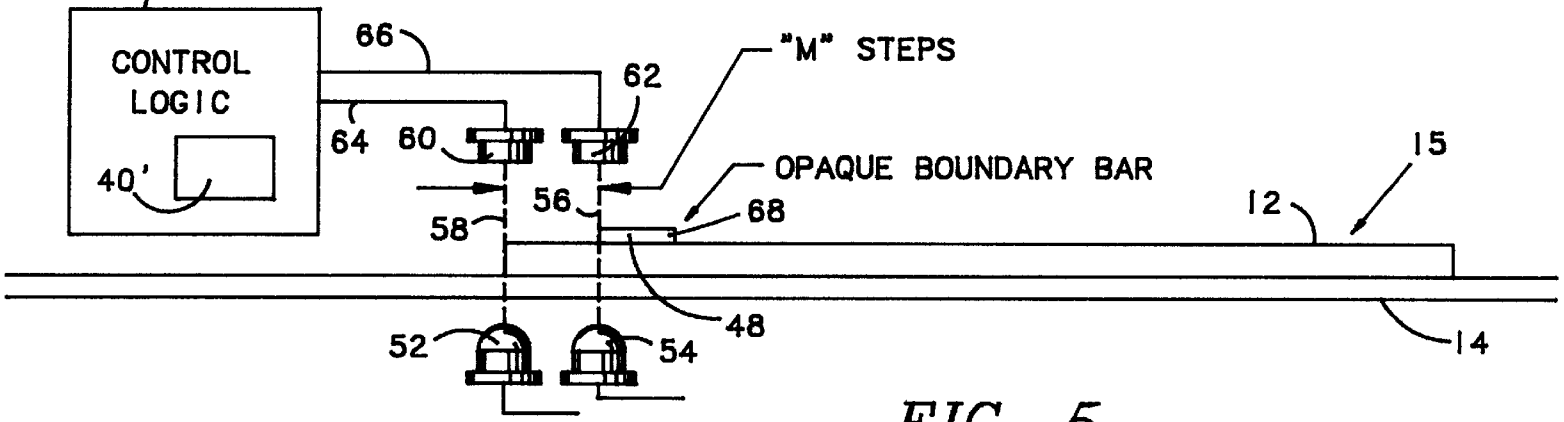
FIG. 5 is a simplified drawing of optical apparatus for sensing the actual offset depicted in FIG. 4.
Figure 6:
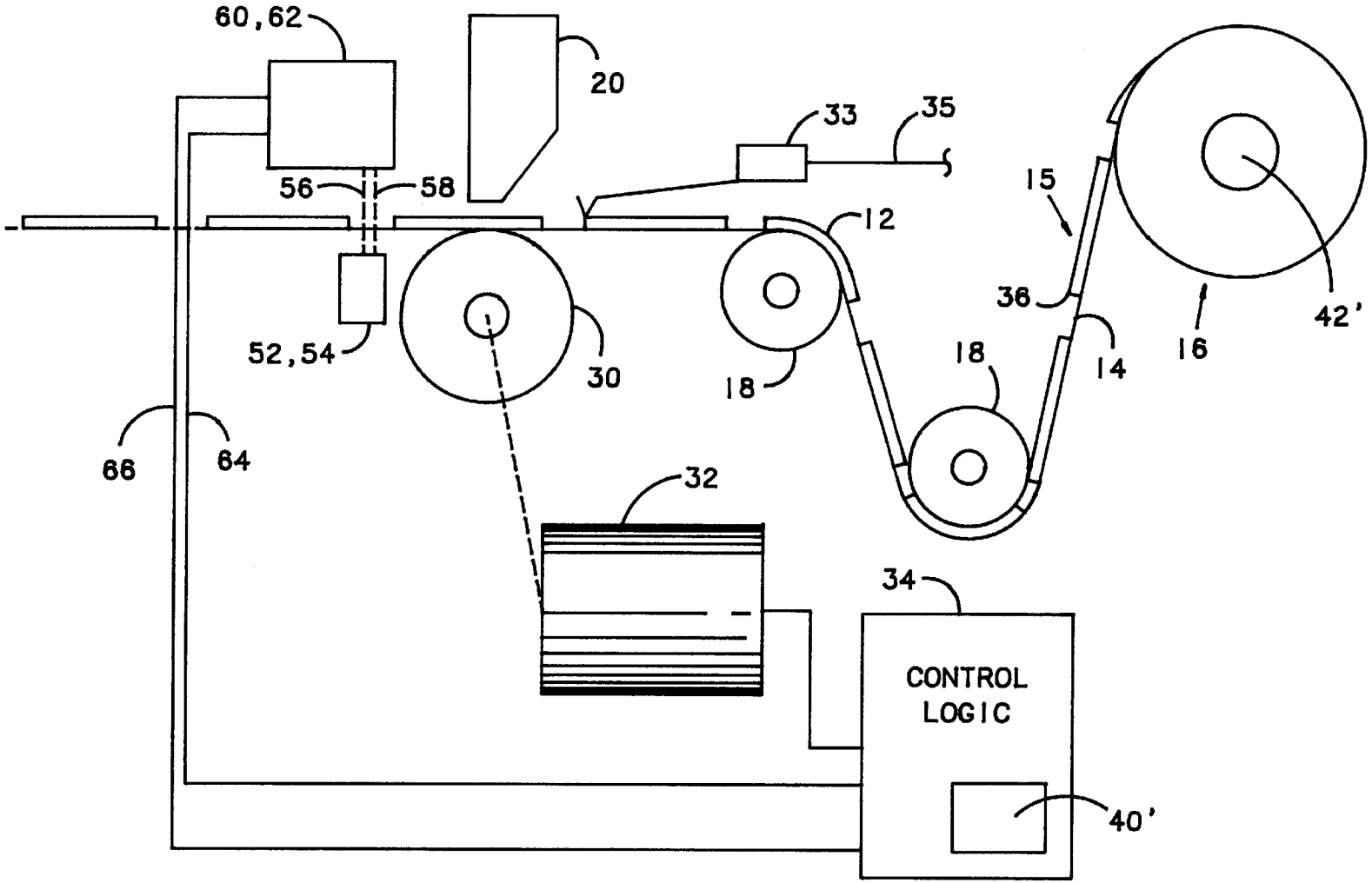
FIG. 6 is a simplified side view drawing and partial functional block diagram of a label printer according to the present invention in an alternate embodiment.

What is needed to implement the closed loop approach within the constraints of the present invention is a simple and inexpensive way to measure the distance between the leading edge 36 and the first bar 48 of the printed barcode 50. Such an apparatus is depicted in FIG. 5. There are a pair of laser diodes 52 and 54 directing narrow laser beams 56 and 58, respectively, on a pair of photodiodes 60 and 62, respectively. The outputs 64 and 66 from the photodiodes 60 and 62 are input to the control logic 34 which contains logic 40' as set forth in FIG. 8. The laser beams 56 and 58 are positioned to be nominally the distance that"M" steps of the stepping motor 32 will produce. The manner of mounting the above-described sensing apparatus is depicted in FIG. 6. Exemplary logic 40' is shown in flowchart form in FIG. 8. Before addressing the logical operation employing the above described sensing apparatus, its manner of operation will first be described. The backing strip 14 of the media 15 has a first transmissivity to light. The backing strip 14 of the media 15 in combination with a label 12 has a second transmissivity to light. And, the backing strip 14 of the media 15 in combination with a label 12 at a point covered with an opaque ink 68 has a third transmissivity to light. It is these three distinct transmissivities that are employed to sense the two transition points of interest as depicted in FIG. 5. By setting the intensity level of the laser beams 56 and 58 in combination with the sensitivity levels of the two photodiodes 60 and 62 in manners well known to those of ordinary skill in the art such as the use of filters, the photodiode 60 can be made to send a signal on line 64 when the transition between the backing strip 14 and the label 12 occurs. Similarly, the photodiode 62 can be made to send a signal on line 66 when the transition between the backing strip 14 in combination with the label 12 and the label 12 with ink 68 on it at the first bar 48 occurs. While light transmissivity is used in the above-described apparatus, those of ordinary skill in the art will also recognize and appreciate that a sensor could also be employed utilizing the differing reflectivity amounts and angles of the surfaces involved.

Figure 8:
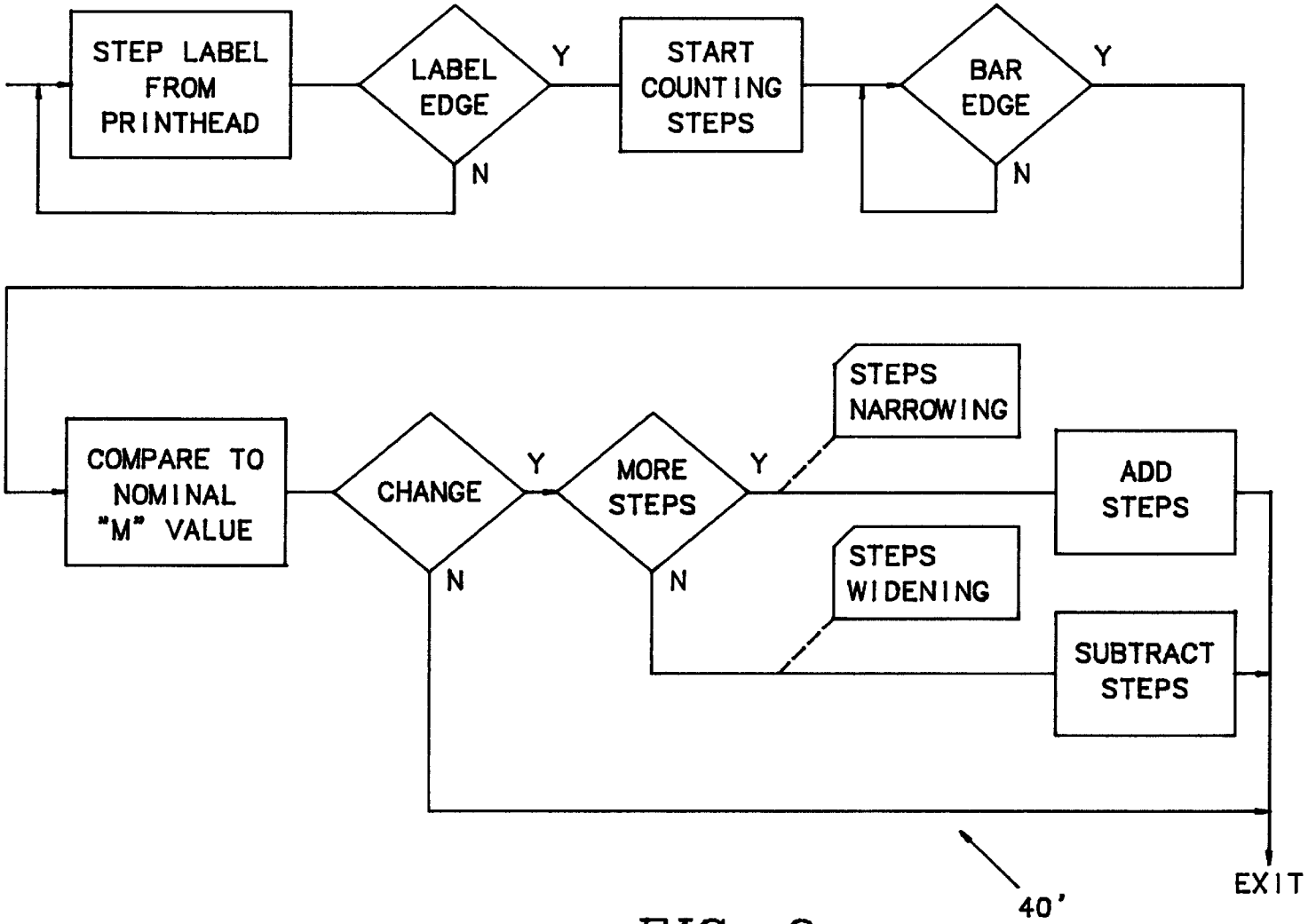
FIG. 8 is a flowchart of exemplary logic to be used in the label printer of FIG. 6.

With particular reference to FIG. 8, the logic 40' monitors the stepping of the label 12 from the printhead 20. In actuality, this is a continuing process where print speed is to be maximized. That is, the labels 12 are constantly moving and the printing and step adjustment is accomplished on-the-fly as it were. When the logic 40' senses the leading edge 36 of the label 12 that has just been printed, it starts counting the steps being applied to the stepping motor 32 and starts watching for the edge of the first bar 48. If the effective step distance is nominally equal to that defining the value"M", the edge of the first bar 48 should be reached in M steps. If it is, no change is made in the number of steps used to step labels 12 from the sensor 33 to the printhead 20. If the edge of the first bar 48 is sensed before M steps have taken place, it means that the barcode 50 is too close to the front edge 36 as a result of an effectively widened step. Thus, the logic 40' subtracts steps as necessary (i.e. one or more) from the number of steps used to step labels 12 from the sensor 33 to the printhead 20. And, the opposite takes place if the effective step distance is narrowing as indicated by it taking more than M steps before the edge of the first bar 48 is found.

Figure 7:
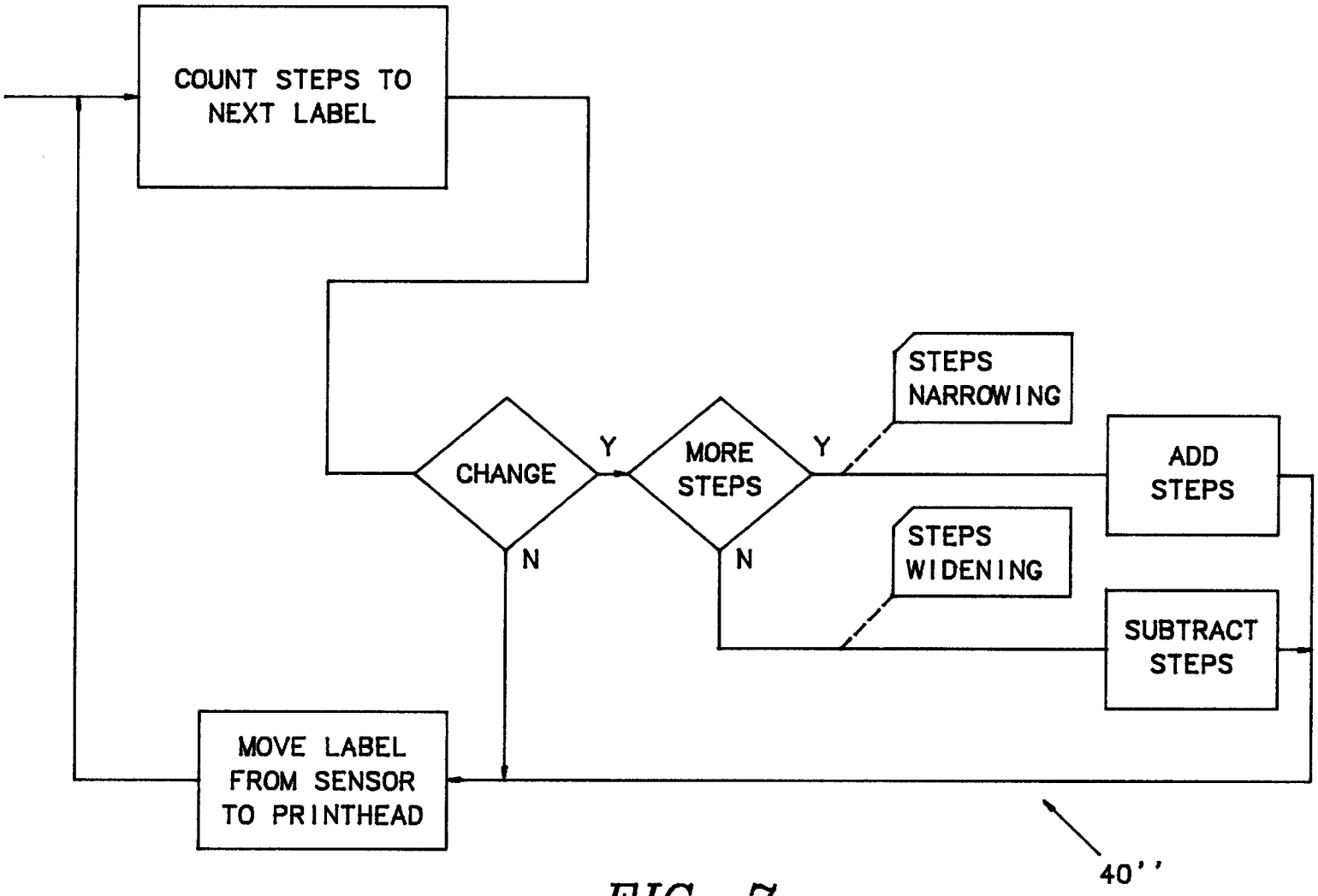
FIG. 7 is a flowchart of alternate exemplary logic which can be used in the label printer of FIG. 1.

As mentioned earlier herein, adjustments could be made to the number of steps employed in the stepping motor 32 on a label-to-label basis without the averaging previously described. As will be noticed, the printer of FIG. 6 does not include the history buffer 38 of FIG. 1. The logic 40" of FIG. 7 could be employed in such an implementation. As will be seen, the logic 40" counts the steps between adjacent labels 12 in any manner desired. If there is no change, the same number of steps is employed to move the next label 12 to the printhead 20 as used previously. If there has been a change, the number of steps is adjusted in a similar manner to that described in detail above before the label 12 is moved.

Thus, it can be seen that the present invention has numerous use capabilities for improving the performance of a label printer, or the like, employing a single stepping motor or multiple motors to drive multiple elements of the apparatus. By dynamically adjusting for variations in effective step size in media movement, the present invention allows freedom of design in the construction of label printers and the like which was heretofore unavailable.

Wherefore, having thus described the present invention, what is claimed is:

1. A method of controlling a barcode label printer having a printhead positioned to print barcodes on labels moving thereunder, a drive roller positioned to move a plurality of labels carried by a backing strip under the printhead for printing thereon, and a stepping motor driving the drive roller so as to accurately control longitudinal label registration as a function of steps of the stepping motor comprising the steps of:

a) outputting a number of steps to the stepping motor to move each label from a known longitudinal position to a registered position under the printhead, b) continuously sensing a start of label point and a start of barcode point on each label just printed and counting steps of the stepping motor required to move each just printed label from the start of label point to the start of barcode point, c) comparing the number of steps of the stepping motor required to move each just printed label from the start of label point to the start of barcode point to a baseline value, and d) adjusting the number of steps to the stepping motor employed to move one label from the known longitudinal position to the registered position under the printhead as a function of any change between a latest counted value of the number of steps of the stepping motor required to move each just printed label from the start of label point to the start of barcode point to a baseline value.

2. The method of claim 1 wherein said step of adjusting the number of steps to the stepping motor employed to move one label from the known longitudinal position to the registered position under the printhead as a function of any change between a latest counted value of the number of steps of the stepping motor required to move each just printed label from the start of label point to the start of barcode point to a baseline value comprises the steps of:

a) adding at least one step to the number of steps employed by the stepping motor if the latest counted value of the number of steps is greater than the baseline value; and, b) subtracting at least one step from the number of steps employed by the stepping motor if the latest counted value of the number of steps is less than the baseline value.

3. In a barcode label printer having a printhead positioned to print barcodes on labels moving thereunder, a drive roller positioned to move a plurality of labels carried by a backing strip under the printhead for printing thereon, and a stepping motor driving the drive roller so as to accurately control longitudinal label registration as a function of steps of the stepping motor, apparatus for dynamically adjusting the steps of the stepping motor to compensate for changes in effective step length effecting longitudinal registration of barcodes printed on the labels comprising:

a) a sensor outputting a first signal upon sensing a leading edge of a just-printed label and outputting a second signal upon sensing a first bar of a barcode of said just-printed label; and, b) control logic connected to said sensor to receive said first signal and said second signal for, b1) outputting a number of steps to the stepping motor to move each label from a known longitudinal position to a registered position under the printhead, b2) continuously sensing a start of label point and a start of barcode point on each label just printed and counting steps of the stepping motor required to move each just printed label from the start of label point to the start of barcode point, b3) comparing the number of steps of the stepping motor required to move each just printed label from the start of label point to the start of barcode point to a baseline value, and b4) adjusting the number of steps to the stepping motor employed to move one label from the known longitudinal position to the registered position under the printhead as a function of any change between a latest counted value of the number of steps of the stepping motor required to move each just printed label from the start of label point to the start of barcode point to a baseline value.

4. The apparatus of claim 3 wherein said step of said control logic of adjusting the number of steps to the stepping motor employed to move one label from the known longitudinal position to the registered position under the printhead as a function of any change between a latest counted value of the number of steps of the stepping motor required to move each just printed label from the start of label point to the start of barcode point to a baseline value comprises the steps of:

a) adding at least one step to the number of steps employed by the stepping motor if the latest counted value of the number of steps is greater than the baseline value; and, b) subtracting at least one step from the number of steps employed by the stepping motor if the latest counted value of the number of steps is less than the baseline value.

* * * * *